US005464113A

United States Patent [19]

Ho et al.

[11] Patent Number: 5,464,113

[45] **Date of Patent: * Nov. 7, 1995**

[54] COLLAPSIBLE HAMPER FOR STORAGE OF LAUNDRY AND OTHER ITEMS

[75] Inventors: Stanley Ho, Warren, N.J.; Mark Ho, Taipei, Taiwan

[73] Assignee: Allure Home Creation Co., Inc., Boonton, N.J.

[ * ] Notice: The portion of the term of this patent subsequent to Oct. 18, 2011, has been disclaimed.

[21] Appl. No.: 234,069

[22] Filed: Apr. 28, 1994

Related U.S. Application Data

[63] Continuation of Ser. No. 921,236, Jul. 29, 1992, Pat. No. 5,356,024.

[30] Foreign Application Priority Data

Mar. 26, 1992 [CN] China ..... 92205228

[51] Int. Cl.[6] ..... B65D 6/26

[52] U.S. Cl. ..... 220/9.2; 220/651

[58] Field of Search ..... 220/9.1, 9.2, 9.3, 220/4.28, 6, 902, 908, 909, 651, 666, 401; 383/117

[56] References Cited

U.S. PATENT DOCUMENTS

| | | | |
|---|---|---|---|
| 1,144,643 | 6/1915 | Elkins | 220/9.2 |
| 1,181,829 | 5/1916 | Bower | 220/9.3 |
| 1,263,294 | 4/1918 | Taylor | 220/9.3 |
| 2,009,035 | 7/1935 | Towers | 383/117 |
| 2,361,743 | 10/1944 | Butler | 220/9.3 |
| 2,625,973 | 1/1953 | Weldon et al. | 220/909 |
| 3,160,307 | 12/1964 | Morrison | 220/902 |
| 3,265,284 | 8/1966 | Tompkins | 220/401 |
| 3,310,089 | 3/1967 | Silverman | 220/9.1 |
| 3,410,328 | 11/1968 | Sasai | 220/9.2 |
| 3,439,865 | 4/1969 | Port et al. | 383/117 |
| 4,180,113 | 12/1979 | Liebling . | |
| 4,246,945 | 1/1981 | Sterling . | |
| 4,248,442 | 2/1981 | Barrett . | |
| 4,585,283 | 4/1986 | Redmon et al. . | |
| 4,683,927 | 8/1898 | Pyzer | 220/902 |
| 4,730,748 | 3/1988 | Bane | 220/902 |
| 4,779,794 | 10/1988 | Moore . | |
| 4,781,300 | 11/1988 | Long . | |
| 4,948,077 | 8/1990 | Gonzalez . | |
| 5,143,283 | 9/1992 | Lancaster | 220/651 |
| 5,195,649 | 3/1993 | Wolters | 220/908 |
| 5,253,775 | 10/1993 | Gould | 220/909 |
| 5,356,024 | 10/1994 | Ho et al. . | |

FOREIGN PATENT DOCUMENTS

| | | | |
|---|---|---|---|
| 5939 | of 1915 | United Kingdom | 220/9.2 |
| 2126535 | 3/1984 | United Kingdom . | |
| 2212114 | 7/1989 | United Kingdom . | |

*Primary Examiner*—Stephen J. Castellano
*Attorney, Agent, or Firm*—Curtis, Morris & Safford

[57] ABSTRACT

The present invention relates to a collapsible hamper, used for the storage of laundry or other items comprising a rigid upper frame, a rigid lower frame, a lid movably hinged to the upper frame, a flexible side wall woven out of polypropylene strips, fabric or other weavable material, and a plurality of supporting rods removably secured between the upper and lower rigid frames, which define a three dimensional internal storage space and decorative external structure that is attractive to the eye when the hamper is assembled for use and which can be easily disassembled and collapsed for convenient storage or transport when not in use.

15 Claims, 5 Drawing Sheets

COLLAPSIBLE HAMPER FOR STORAGE OF LAUNDRY AND OTHER ITEMS

This application is a continuation of application Ser. No. 07/921,236, filed Jul. 29, 1992, now U.S. Pat. No. 5,356, 024.

BACKGROUND OF THE INVENTION

This invention relates to hampers for the storage of items, particularly for the storage of laundry, which can easily be assembled, disassembled and folded to provide the advantages of convenient storage, use and ease of display and also provide a decorative hamper that is attractive to the eye when assembled for use.

DESCRIPTION OF THE PRIOR ART

To date, a variety of laundry basket and container designs for use in the storage and carrying of laundry have been made to promote various aspects relating to the convenience of use and storage of such containers. For example, U.S. Pat. No. 4,781,300 discloses a laundry basket with hinged rigid side walls and U.S. Pat. No. 4,948,077 discloses a foldable basket assembly on a laundry buggy. However, none of the prior art designs possesses the combination of features disclosed and claimed herein, namely a decorative hamper with a woven flexible side wall structure that can be easily disassembled and collapsed for convenience of storage, transport and display.

SUMMARY OF THE INVENTION

The side wall of the hamper constituting the invention is fabricated from a sheet of weavable material and is secured about the circumference of an upper and a lower rigid frame to define a decorative storage structure. The side wall is preferably fabricated from thin polypropylene strips or fabric strips, to provide a flexible woven wall structure which is collapsible when the hamper is disassembled for transport or storage, yet appears as a uniform woven surface when the hamper is assembled for use. The upper and lower rigid frames are preferably made from a moldable plastic such as commercial grade polypropylene or polyethylene, but can also be fabricated from other structural materials such as wood or lightweight aluminum, to provide a rigid thin walled frame structure upon which the flexible side wall can be circumferentially secured by staples, screws or other common fastening methods. The upper and lower frames define the particular circumferential shape of the assembled hamper. The lid or cover of the hamper is also movably attached, preferably with hinges, to the upper rigid frame which can be opened and closed as laundry or other items are stored or removed from the internal space of the assembled hamper. The lid is also preferably fabricated of a planar rigid plastic or particleboard material with padding secured thereupon, both of which are covered by a sheet of woven material that matches the woven material of the flexible aide wall to achieve a uniform woven surface for the hamper lid. The rectangular upper and lower rigid frames are also constructed to provide raised flanges or cavities in the frame structure to accommodate a number of supporting rods, which are removably installed between the lower and upper surfaces of the upper and lower frame, respectively, to define a three dimensional internal storage space and uniform external structure of the flexible side wall of the assembled hamper. Each supporting rod extending between the upper and lower frames is of sufficient length so that, when each said rod is installed within the flanges or cavities provided in said upper and lower rigid frames, the flexible woven side wall is stretched and extended to achieve the appearance of a solid uniform wall. Each supporting rod may be fabricated from any lightweight structural material, such as wood, aluminum or a moldable plastic and is preferably fabricated of a semi-circular cross-section. The rounded surface of each supporting rod, as installed, is preferably in contact with the flexible woven side wall to form rounded corners in the flexible side wall extending between the upper and lower frames when the hamper is assembled. Several evenly or randomly spaced slots or perforations are also provided in the lower rigid frame to promote the ventilation of air into and out of the internal hamper storage space to prevent an excessive accumulation of undesirable odors due to the storage of soiled laundry or other such items. Leg members are also provided for in the lower frame extending downwardly from the bottom surface thereof to provide a satisfactory space between the floor and the perforations of said lower rigid frame to accommodate the ventilation of air through the internal storage space of said hamper.

It is a principal object of the present invention to provide a collapsible hamper or container, the side wall of which has the appearance of a uniform wicker or woven fabric, is easy to assemble or disassemble, can consequently be conveniently stored, displayed and transported, and yet is pleasing to the eye when assembled for use so that it is particularly suitable for decorative interior applications.

It is an additional object of the invention to provide a collapsible hamper or container wherein the flexible side wall is fabricated from a plurality of strips of flexible material, such as thin strips of polypropylene or natural or synthetic fabric material, giving the appearance of a wicker or woven side wall, which is easy to clean and provides a smooth surface which prevents damage to delicate clothing or other items that are stored within and removed from the internal storage space of the hamper. Such a flexible woven side wall also allows the ventilation of air into and out of the inside storage space to reduce the undesirable odor of soiled clothes or other items that may be stored within the container space.

It is a further object of the invention to provide a lightweight collapsible hamper that is very economical to manufacture and assemble.

DESCRIPTION OF THE PREFERRED EMBODIMENT

Figure 1:
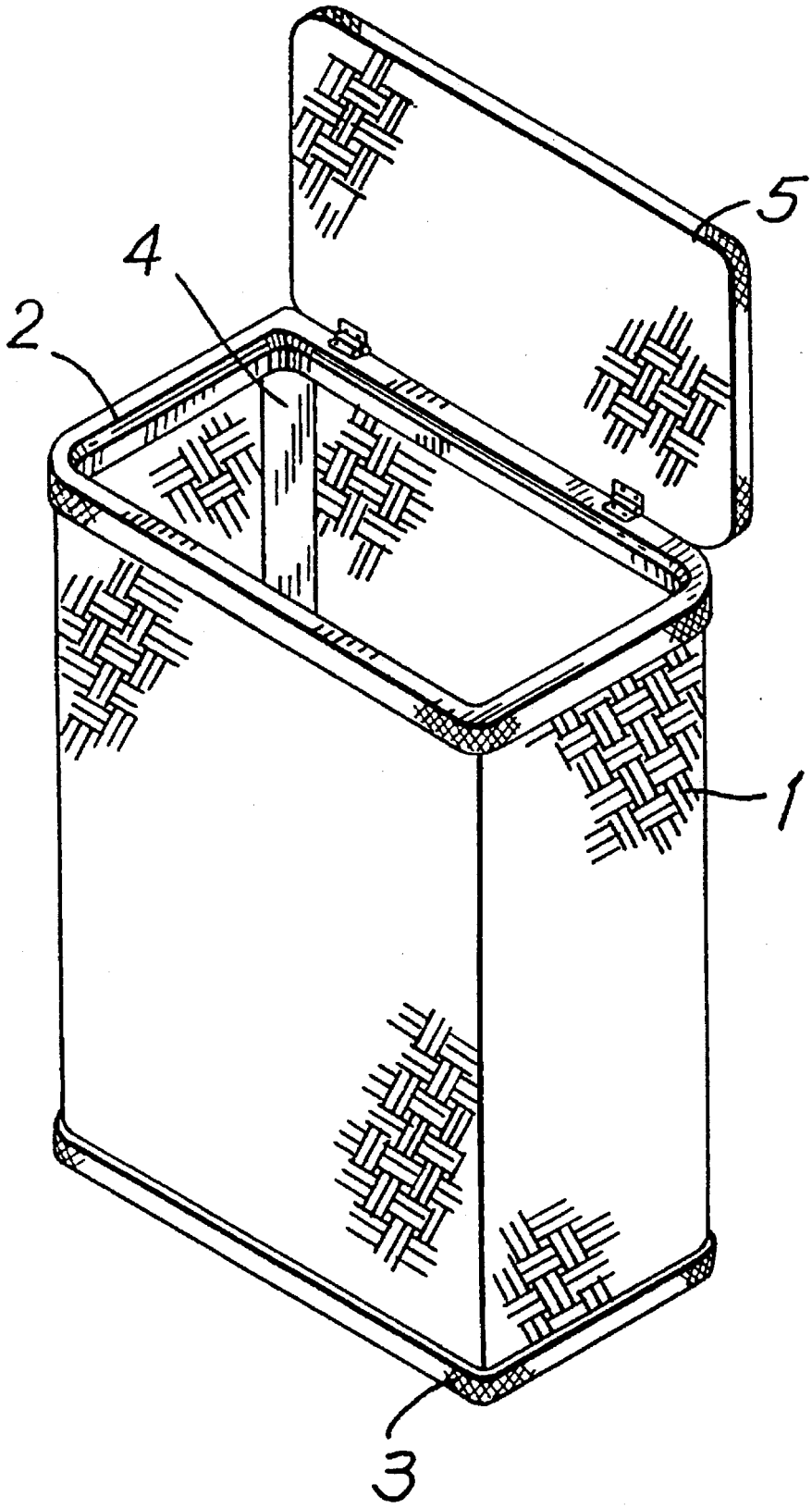
FIG. 1 is a perspective view of the assembled hamper.

With reference to the drawings, FIG. 1 shows an overall perspective view of the assembled hamper or container with the movable lid 5 in an opened position. The assembled hamper comprises a flexible side wall 1, a rectangular rigid upper frame 2, a rectangular rigid lower frame 3, four supporting rods 4 removably secured and extending between said upper and lower rigid frames and a lid 5 hingably secured to the rigid upper frame 2. The flexible side wall 1 constitutes a sheet of flexible material preferably fabricated from a plurality of polypropylene strips made through the extrusion process, but can also be made of natural or synthetic fabric strips or other flexible material. The physical properties of the flexible side wall enable the user to fold the hamper for storage upon disassembly thereof into a conveniently storable size when not in use or when transporting said hamper. This feature additionally promotes economy of packaging, shipping and display in retail outlets, as the disassembled hampers can be packaged in a compact carton for shipping and display. Each supporting rod 4 is removably secured between each corner of said rectangular upper and lower rigid frames so that an ample internal storage space and an external appearance of a solid uniform woven side wall structure, such as wicker, is achieved.

Figure 2:
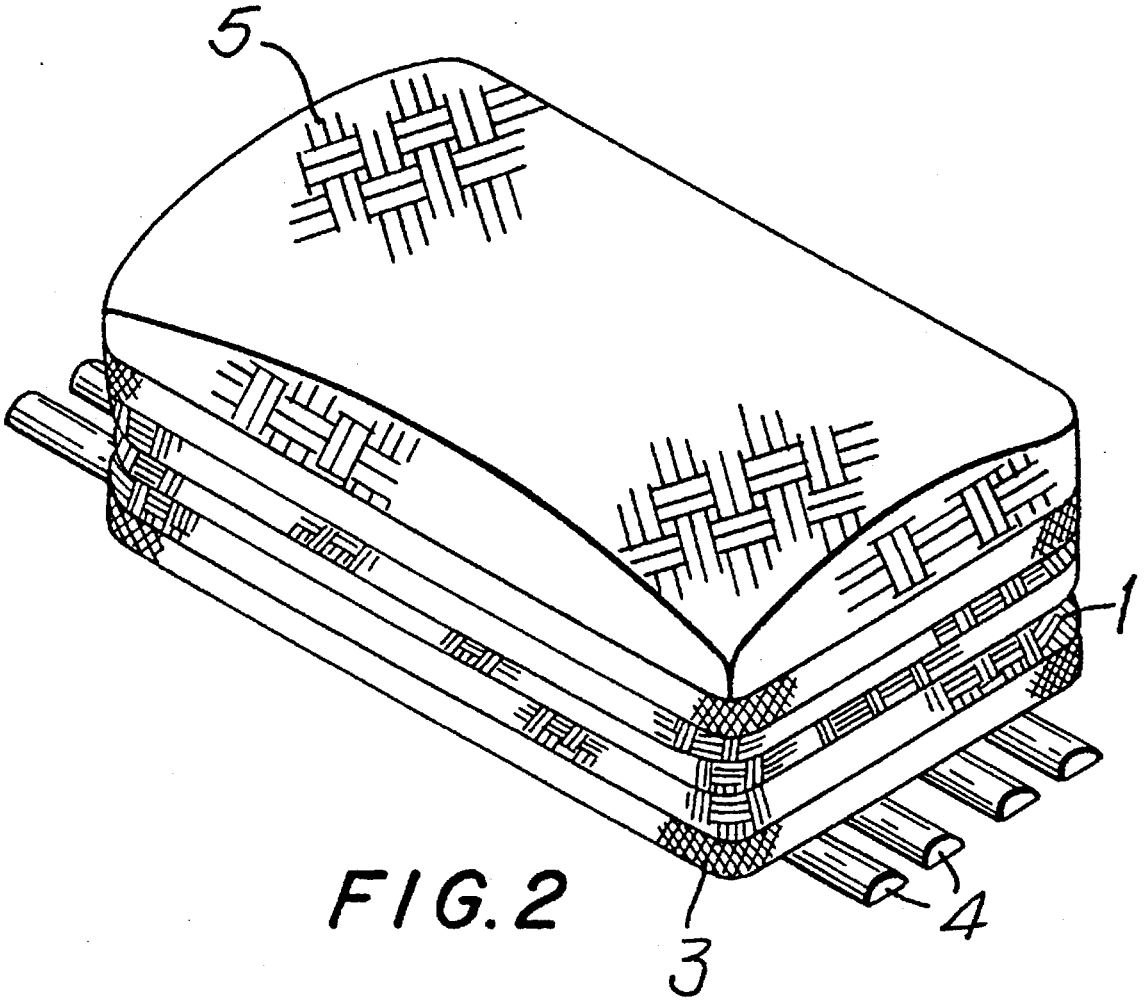
FIG. 2 illustrates a perspective view of the disassembled hamper as collapsed for storage.

FIG. 2 illustrates the hamper when disassembled and collapsed for storage. The supporting rods 4 are removed from the cavities provided in the upper and lower rigid frames enabling the flexible side wall 1 to collapse, allowing the upper rigid frame 2 to drop down upon the lower rigid frame 3.

Figure 3:
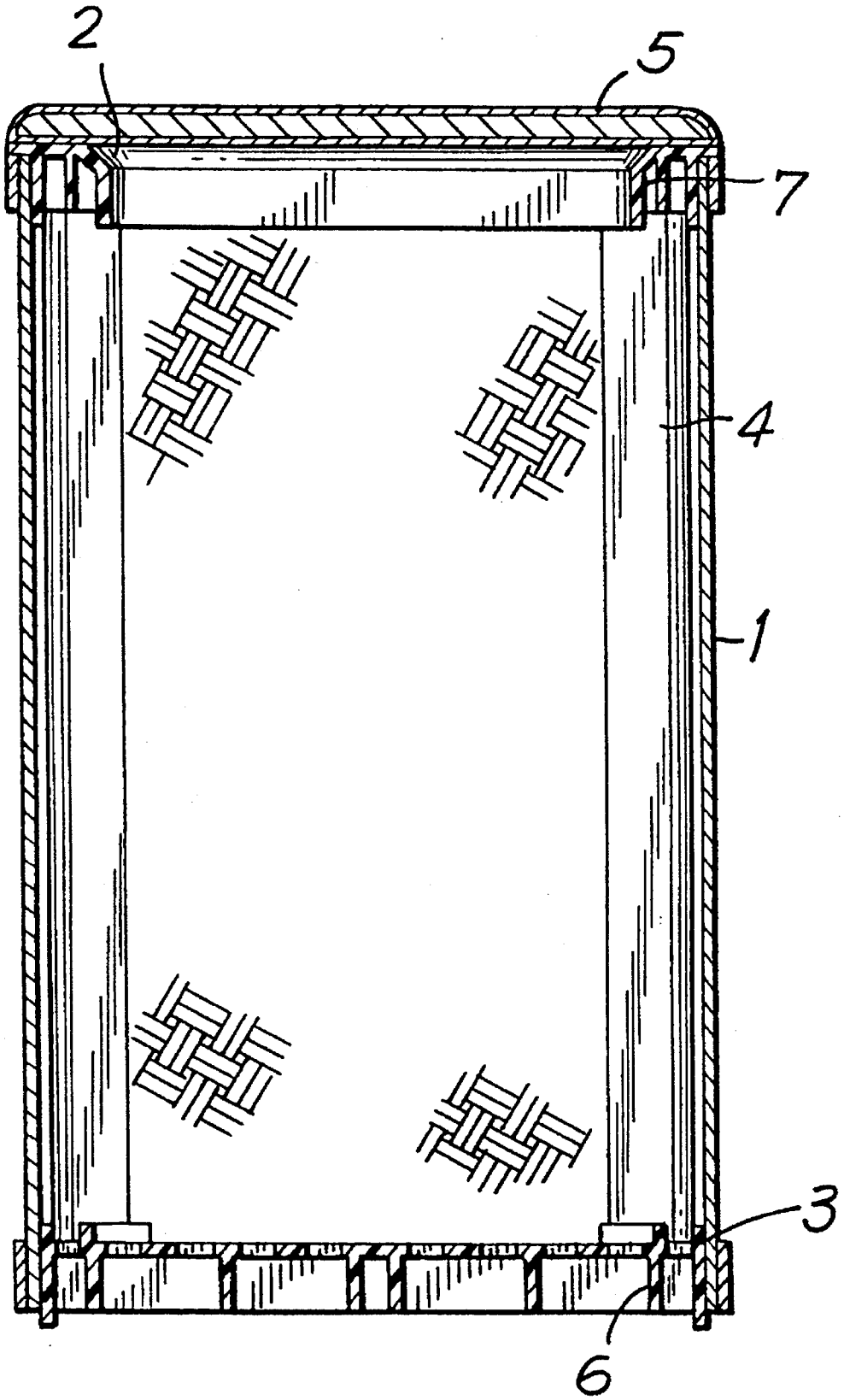
FIG. 3 illustrates a sectional view of a front elevation of the as assembled hamper.

FIG. 3 illustrates a cross-sectional elevation of the assembled hamper. The supporting rods 4 are removably installed between the lower rigid frame 3 and the upper rigid frame 2 so that each supporting rod 4 remains in a substantially vertical position when the hamper is assembled. This cross-section also illustrates the preferred construction of the upper rigid frame 2 as a thin-walled molded plastic part 7 and the lower rigid frame 3 as a thin-walled molded plastic part having structural ribs 6 for additional strength and rigidity.

Figure 4:
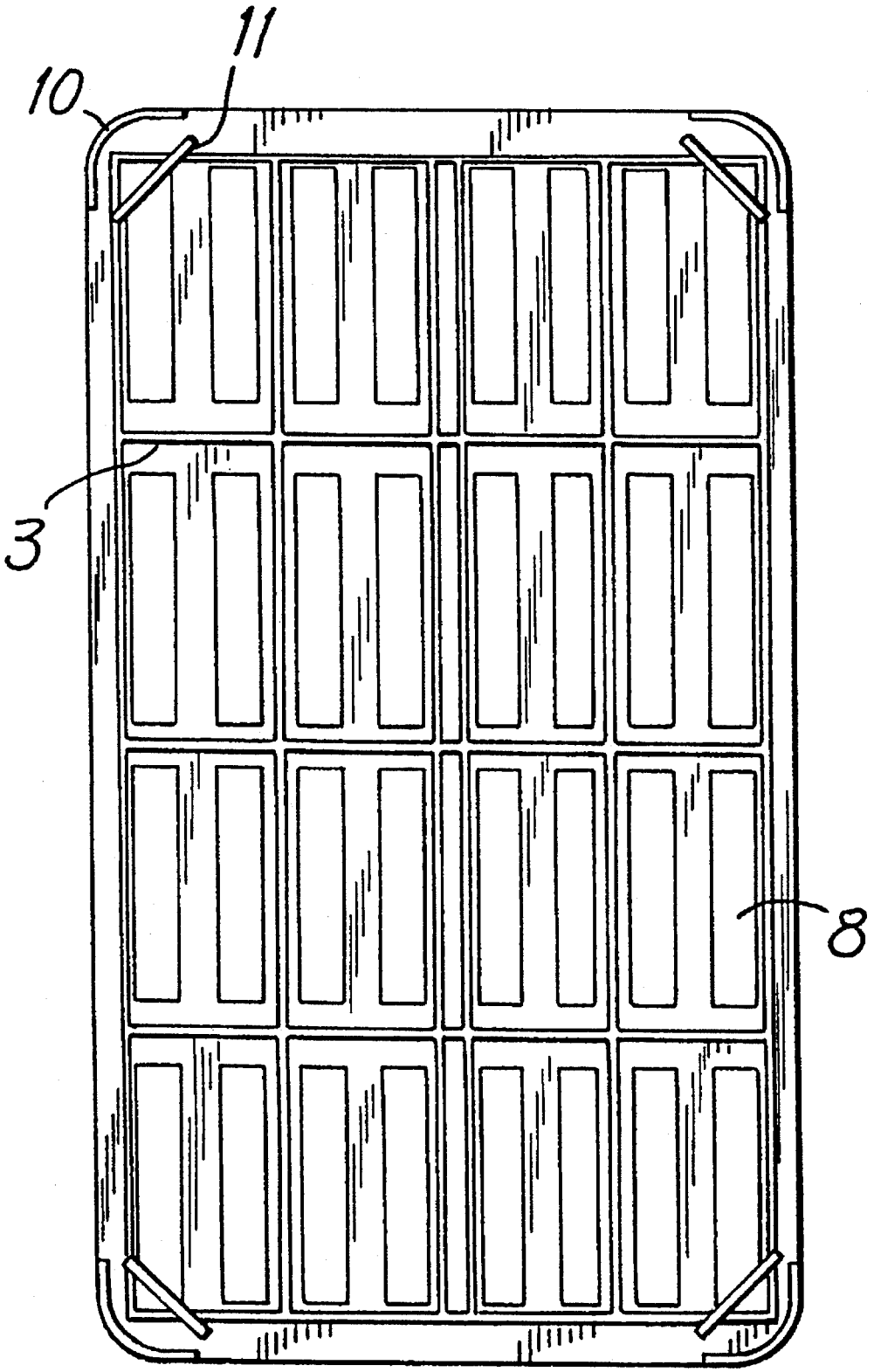
FIG. 4 illustrates the bottom view of the hamper which depicts the slotted perforations and leg members of the lower rigid frame.

FIG. 4 illustrates a bottom view of said hamper which depicts the bottom surface of the lower rigid frame 3. Uniform slots or perforations 8 are provided in the lower rigid frame to promote air flow into and out of the internal hamper space. Downwardly extending legs 10 and 11 are further provided at each corner of said frame to provide for a satisfactory space between the slots or perforations 8 and the floor.

Figure 5:
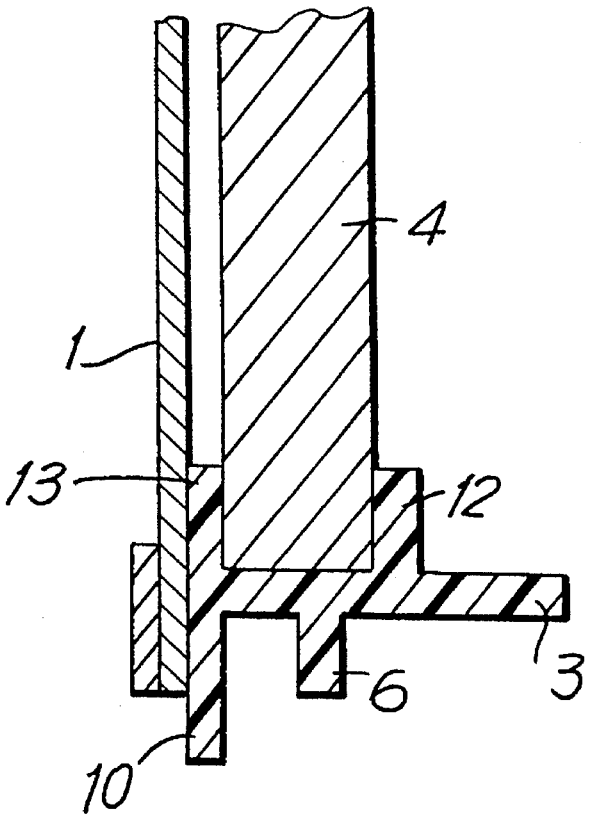
FIG. 5 illustrates a close-up sectional view of one of the supporting rods as installed into one of the cavities provided in the lower rigid frame when the hamper is assembled for use.

FIG. 5 illustrates a close-up cross-sectional view of the supporting rod 4 as installed in its removably fixed position between upwardly extending flanges or tabs 12 & 13 molded into the lower rigid frame 3. The cross-section also depicts one of the downwardly extending tabs 10 which serves as a leg for the hamper.

Figure 6:
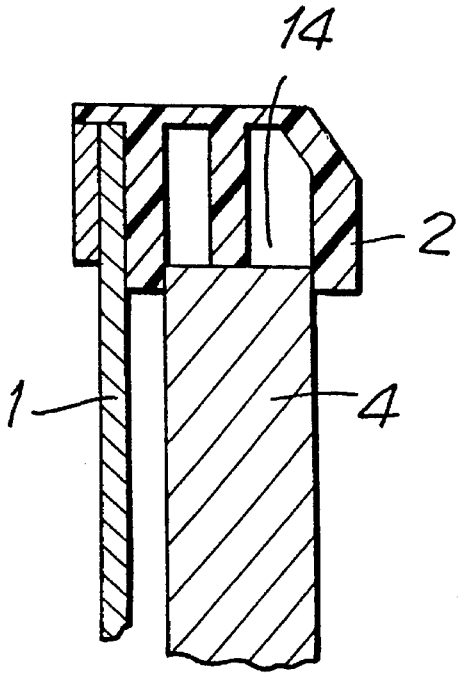
FIG. 6 illustrates a close-up sectional view of one of the supporting rods as installed into one of the cavities provided in the upper rigid frame when the hamper is assembled for use.

FIG. 6 illustrates a close-up cross-sectional view of one of the supporting rods 4 removably installed within one of the cavities 14 provided for in the molded upper rigid frame 2.

The above description has been set forth with reference to the preferred embodiment. However, modifications, alterations and other applications of the invention may occur to those skilled in the art upon reading and understanding the specification.

Having thus described my invention, I claim:

1. A collapsible container comprising:

a side wall substantially fabricated of a sheet of flexible material, an upper rigid frame having a first circumferential surface, a lower rigid frame having a second circumferential surface, a plurality of supporting rods removably secured and extending between said upper rigid frame and said lower rigid frame to define a three dimensional internal storage space, the side wall having top and bottom edges which are secured about the first and second circumferential surfaces of said upper rigid frame and said lower rigid frame, respectively and enclose the plurality of supporting rods when the supporting rods extend between the upper rigid frame and the lower rigid frame.

2. The collapsible container as claimed in claim 1, in which the flexible material is dimensioned to stretch between the upper rigid frame and the lower rigid frame and around the plurality of supporting rods to achieve the appearance of a solid side wall when the plurality of supporting rods are secured and extending between said upper rigid frame and said lower rigid frame.

3. The collapsible container, as claimed in claim 1, in which said lower rigid frame comprises a horizontal surface having a plurality of perforations in said horizontal surface, and includes downwardly extending legs sufficient to provide space below said horizontal surface to allow air to flow into and out of said collapsible container through the plurality of perforations in said horizontal surface.

4. The collapsible container, as claimed in claim 2, wherein the circumferential shape of the container is defined by the first and second circumferential surfaces.

5. The collapsible container, as claimed in claim 4, wherein the flexible material is formed from a plurality of woven strips.

6. The collapsible container, as claimed in claim 5, wherein the flexible material has the appearance of wicker.

7. A collapsible container comprising:

a side wall substantially fabricated of a sheet of flexible material, an upper rigid frame, a lower rigid frame, said side wall being secured about the outside circumferential surface of said upper rigid frame and said lower rigid frame, respectively, a plurality of supporting rods removably secured and extending between the downward surface of said upper rigid frame and the upward surface of said lower rigid frame to define a three dimensional internal storage space, and said upper rigid frame further including, an outside wall, and an inside wall, said outside wall having a circumference greater than said inside wall, a substantially horizontal wall extending between said inside wall and said outside wall, a plurality of support ribs, downwardly extending from the bottom surface of said horizontal wall, between said inside and outside walls, and a plurality of cavities adjacent the lower edges of said downwardly extending ribs for removably securing each said supporting rod in position when said container is assembled for use, said upper rigid frame further defining an opening within the inside surface of said inside wall to accommodate storage and removal of items in the container.

8. A collapsible container comprising:

a side wall having top and bottom edges substantially fabricated of a sheet of flexible material, an upper rigid frame having a lower surface and a first outside circumferential surface, a lower rigid frame having an upper horizontal surface and a second outside circumferential surface, the top and bottom edges of said side wall being secured about the first and second outside circumferential surfaces of said upper rigid frame and said lower rigid frame, respectively, a plurality of supporting rods removably secured and extending between the lower surface of said upper rigid frame and the upper surface of said lower rigid frame thereby defining a three dimensional internal storage space, and said lower rigid frame further including, a plurality of perforations throughout said upper horizontal surface, a plurality of upwardly extending flanges for removably securing each of said supporting rods therebetween and maintaining each said supporting rod in position when said hamper is assembled for use, and downwardly extending legs of a length sufficient to provide space between said upper horizontal surface of said lower rigid frame and a floor on which said container may be located whereby air may flow into and out of said internal storage space through said perforations.

9. The container as claimed in claim 8, wherein said lower rigid frame and said upper rigid frame are molded polypropylene and rectangular in shape.

10. The container as claimed in claim 9, wherein said flexible material is formed from a plurality of woven strips of polypropylene or natural fabric.

11. The container as claimed in claim 8, wherein said flexible material has the appearance of wicker.

12. The container as claimed in claim 8, wherein the circumferential shape of the container is defined by the first and second outside circumferential surfaces.

13. The container as claimed in claim 12, wherein the circumferential shape of the container is substantially rectangular.

14. A kit for assembly into a collapsed container comprising:

an upper rigid frame having an outer surface, an inner surface, an upper surface, a lower surface, and a plurality of first cavities formed below the upper surface and between the outer and the inner surfaces, a lower rigid frame having an outer surface, an inner surface, an upper surface, a lower surface, and a plurality of second cavities formed above the lower surface and between the outer and the inner surfaces, a side wall fabricated of a collapsible flexible material, said side wall being attached to the upper and lower rigid frames, when the container is in use, a plurality of supporting rods having a length sufficient to maintain the side wall in tension between the upper and lower rigid frames, each rod having a first end for matingly and removably fitting into one of said first cavities and a second end for matingly and removably fitting into one of said second cavities, wherein each of said first and second cavities are paired and in substantial alignment to receive said rods with tension on the side wall when the container is assembled, and the side wall and the upper and the lower rigid frames collapse as one unit when the plurality of supporting rods are not assembled into the plurality of the first and second cavities and the container is not assembled.

15. The kit for assembly into a collapsed container as claimed in claim 14, wherein said collapsible flexible material has a decorative appearance.

* * * * *